US008267606B2

(12) United States Patent
Delbove et al.

(10) Patent No.: US 8,267,606 B2
(45) Date of Patent: Sep. 18, 2012

(54) DEVICE FOR PACKAGING AND DISPENSING A STICK OF PRODUCT ESPECIALLY A COSMETIC PRODUCT

(75) Inventors: William Delbove, Paris (FR); Lionel Drugeon, La Garenne Colombes (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/886,292

(22) Filed: Sep. 20, 2010

(65) Prior Publication Data

US 2011/0123249 A1 May 26, 2011

(30) Foreign Application Priority Data

Sep. 18, 2009 (FR) ..... 09 56431

(51) Int. Cl.
*B43K 21/08* (2006.01)
*B43K 5/16* (2006.01)

(52) U.S. Cl. ..... 401/78; 401/59; 401/68; 401/75; 401/77; 401/116

(58) Field of Classification Search ..... 401/59, 401/60, 77, 78, 68, 75, 116
See application file for complete search history.

(56) References Cited

U.S. PATENT DOCUMENTS

| | | | | |
|---|---|---|---|---|
| 2,043,890 | A * | 6/1936 | Florman | 401/60 |
| 3,230,960 | A * | 1/1966 | Moore et al. | 401/78 |
| 4,973,178 | A * | 11/1990 | Kakuta et al. | 401/59 |
| 4,983,059 | A * | 1/1991 | Holloway | 401/78 |
| 6,012,863 | A | 1/2000 | Sakurai | |
| 6,056,465 | A * | 5/2000 | Kuo | 401/60 |
| 6,315,479 | B1 * | 11/2001 | Sakurai | 401/59 |
| 7,237,973 | B1 * | 7/2007 | Lou et al. | 401/116 |
| 7,422,387 | B2 * | 9/2008 | Kurihara et al. | 401/78 |
| 2006/0067781 | A1 * | 3/2006 | Pleil et al. | 401/116 |
| 2007/0217857 | A1 * | 9/2007 | Ho | 401/78 |
| 2008/0025785 | A1 * | 1/2008 | Ma et al. | 401/87 |
| 2009/0188513 | A1 * | 7/2009 | Delbove | 401/78 |
| 2011/0070012 | A1 * | 3/2011 | Kim et al. | 401/68 |

FOREIGN PATENT DOCUMENTS

| | | |
|---|---|---|
| CA | 1331965 | 9/1994 |
| FR | 2 908 964 | 5/2008 |
| WO | 2007/066855 | 6/2007 |

OTHER PUBLICATIONS

French Search Report dated Jul. 21, 2010.

* cited by examiner

*Primary Examiner* — David Walczak
*Assistant Examiner* — Bradley Oliver
(74) *Attorney, Agent, or Firm* — Oblon, Spivak, McClelland, Maier & Neustadt, L.L.P.

(57) ABSTRACT

A device for packaging and dispensing a product includes a dispensing assembly provided with a holding cup for the product, a sheath in which the cup is mounted, a jacket around the sheath and including an outlet orifice, and an outer sleeve around the jacket. Guide devices are provided to bring about, during a rotation of the outer sleeve relative to said jacket, a joint axial movement of said sheath and of the holding cup relative to the jacket, followed by an axial movement of said cup relative to the guide sheath and to the jacket towards a use position of the product. A protective case in which the dispensing assembly is mounted, forms an outer cover for the assembly and includes an actuating member that is able to rotate the outer sleeve.

13 Claims, 5 Drawing Sheets

DEVICE FOR PACKAGING AND DISPENSING A STICK OF PRODUCT ESPECIALLY A COSMETIC PRODUCT

CROSS-REFERENCE TO RELATED APPLICATIONS

This application claims the benefit of priority under 35 U.S.C. §119(e) of Provisional Patent Application No. 61/247,154 filed Sep. 30, 2009, and claims the benefit of priority under 35 U.S.C. §119 from French Application No. 0956431 filed Sep. 18, 2009, the entire contents of each of which are herein incorporated by reference.

BACKGROUND OF THE INVENTION

1. Field of the Invention

The present invention relates to devices for packaging and dispensing a product, especially a cosmetic product.

2. Discussion of Background

"Cosmetic product" here means a product as defined in Council Directive 93/35/EEC of 14 Jun. 1993.

The present invention relates more specifically to devices for packaging and dispensing a stick of product such as lipstick, foundation, eye shadow, face powder, concealer, a medicated, cleansing or moisturizing composition, a deodorant, or a hair care product.

This sort of stick is usually packaged in a device of the type provided with a cup to support said stick moveably inside a sheath, a jacket around the sheath, and an outer sleeve around the jacket. Means for driving the cup are also provided to bring about, when an actuating member connected to the jacket is rotated, its axial movement inside the sheath between a storage position and a use position of the stick. The drive means may in particular take the form of studs on the cup and sheath engaging in grooves formed in the jacket, the sheath and the outer sleeve. For more details the reader may refer to U.S. Pat. No. 6,056,465, for example.

The product stick is generally consumed relatively quickly and the device is thrown away when the stick is finished. For this reason the component parts of the device are made cheaply as mouldings of inexpensive plastics.

However, the outer sleeve and the actuating member of the device of that patent are visible to the user from the outside.

That device is therefore not suitable for a luxury application because in such an application the use of low-cost plastics may tend to give the user an unfavourable impression.

What is more, given the dimensions of conventionally packaged cosmetic sticks, the size of the device is somewhat small, which can be a problem when it comes to holding it and twisting the actuating member in order to dispense the product.

It is also known, by document WO 2007/066855, a device for packaging and dispensing a lipstick comprising a dispensing assembly having a holding cup for the lipstick, a sheath in which the cup is mounted, a jacket around said sheath and an outer sleeve around the jacket and able to be rotated relative to said jacket. The sheath comprises a stud projecting through a longitudinal groove of the jacket and entering a first helicoidal groove in the outer sleeve. The holding cup comprises a stud projecting through a groove of the jacket and entering a longitudinal groove of the sheath and a second helicoidal groove of the outer sleeve. The device also comprises a case for the dispensing assembly comprising a rotary body mounted on the jacket, a tubular outer body and a lid mounted on said body.

CA 1 331 965 discloses a device for packaging and dispensing a lipstick comprising a holding cup, a sheath in which the cup is mounted, a jacket around said sheath and an outer sleeve around the jacket and able to be rotated relative to said jacket. The device also comprises tubes forming a casing for the dispensing assembly, one of the tubes being adapted to rotate the outer sleeve. To enable an axial movement of the holding cup, the outer sleeve comprises a stud extending radially inwards and engaging with a helicoidal groove in the jacket.

With such devices as disclosed in these two documents, when the associated actuating member rotates the outer sleeve, a relative movement of rotation occurs between the lipstick and the upper part of the case. Thus, if a lipstick and a case each comprising a bevelled upper end are used, these two ends are not always parallel relative to one another in the use positions of the lipstick.

Therefore, the user does not know how to position the upper part of the case with respect to the surface to be treated before the outlet of the lipstick outside the case.

SUMMARY OF THE INVENTION

It is therefore an object of the present invention to solve the problems of the previous devices.

More specifically, it is an aim of the present invention to provide a device for packaging and dispensing a product, particularly a cosmetic product, that can easily be held and manipulated and be adapted to a luxury application.

It is a further aim of the present invention to provide a device that is easy to manufacture, inexpensive and transportable without the risk of damage to the product-dispensing components.

It is a further aim of the present invention to provide a device adapted to enable to the user to know, before the outlet of the product, how to position the device with respect to the surface to be treated in such a way as to obtain, after the outlet of the product, the desired orientation of the upper end of said product with regard to the surface to be treated.

In one embodiment, the device for packaging and dispensing a product, particularly a cosmetic product, comprises a dispensing assembly having a holding cup that forms a seat for the product, a sheath in which the cup is mounted, a jacket around said sheath and comprising a product outlet orifice, and an outer sleeve around the jacket and able to be rotated relative to said jacket. The jacket has a guide means that engages with a groove in the sheath to bring about, when the outer sleeve is rotated about an axis that cuts the outlet orifice, a joint axial movement of the sheath and holding cup relative to the jacket between a storage position and a partly extended position. The sheath and the jacket further comprise grooves that engage with a guide means on the holding cup to bring about, when the outer sleeve is rotated, an axial movement of said cup relative to the sheath and to the jacket between the partly extended position and a use position of the product.

The device further comprises a protective case in which the dispensing assembly is mounted and which forms the outer cover of said assembly. The protective case has an actuating member able to rotate the outer sleeve.

The protective case can easily be made of a material suitable for a luxury application, such as a metallic material, to which decorations, pictographs or a trade mark can be applied, and which can protect a dispensing assembly formed by the holding cup, the sheath, the jacket and the outer sleeve, which can thus be made from low-cost materials. It is therefore possible to envisage an outer covering suitable for a luxury application for this dispensing assembly without increasing the cost price of said assembly. Once the product has been completely used by the consumer, the protective case can be kept for reuse with another dispensing assembly of a similar design forming a refill for the case.

The design of the device, and notably the provision on the jacket of the guide means, enables to maintain the orientation of the product with respect to the upper part of the protective case during the movement of the product between the storage position and the use position. In fact, during the movement of the holding cup, the product does not move in rotation relatively to the upper part of the casing case, notably relatively to a cap of the casing. There is no rotational relative movement between the product and the upper part of the protective case. The guide means of the jacket cooperating with the groove of the sheath enables to obtain the guiding of the holding cup and of the product relatively to the upper part of the protective case only in translation.

Thus, if a product and a case each comprising a bevelled upper end are used, the device enables to maintain the relative orientation of said upper ends during the movement of the product between the storage position and the use position. Before the outlet of the product, the user thus knows how to position the upper end of the protective case with respect to the surface to be treated in such a way as to obtain, in the outlet position of the product, the desired orientation of the upper end of the product with respect to said surface to be treated.

In addition, the protective case increases the thickness of the device, and more generally its overall size, which makes it easier to hold in the hand and operate when dispensing the product.

The dispensing assembly is advantageously mounted removably in the protective case.

The actuating member advantageously forms a base for mounting at least part of the outer sleeve. The actuating member may have rotary drive means able to engage with complementary drive means belonging to the outer sleeve. In one embodiment this engagement occurs by complementarity of shape.

In one embodiment, the protective case has a cap in which the dispensing assembly is housed. The cap is separate from the control member. The cap can rest on the actuating member.

The protective case may have a lid for the outlet orifice of the jacket that is movable between an orifice-closed position and an open position. The lid is preferably mounted rotatably on the cap. Alternatively, it is possible for the lid to be fitted on said cap by pushing it on.

The lid, the actuating member and the cap define a closed chamber in which the dispensing assembly is completely housed.

In one embodiment, the cap has a bevelled upper surface defining an outlet orifice in the protective case for the product. The product may be packaged in the form of a stick mounted in the holding cup, the stick also having a bevelled upper surface which is advantageously parallel to the bevelled upper surface of the cap when said stick is in the use position. The product stick and the cap are unable to rotate relative to each other, so that the two surfaces remain parallel.

The jacket preferably has a flexible tongue supporting the guide means. This arrangement helps with assembling the device when the jacket is made of a relatively rigid material. For this purpose, additionally, the jacket may be slit at its lower end to facilitate assembly. The jacket may also have a snap-fastening means to retain the outer sleeve axially on the sheath.

In one embodiment, the holding cup has a flexible tongue supporting the guide means. This arrangement enables the holding cup to be mounted in the sheath without having to give the latter an axial groove running out at its lower end to allow the passage of the guide means. The guide means on the cup and/or on the jacket may have a stud.

In one embodiment, the device for packaging and dispensing a product, particularly a cosmetic product, comprises a holding cup that forms a seat for the product, sheath in which the cup is mounted, a jacket around said sheath and comprising a product outlet orifice, and an outer sleeve around the jacket and able to be rotated relative to said jacket. The jacket comprises a guide means that engages with a groove in the sheath to bring about, when the outer sleeve is rotated about an axis that cuts the outlet orifice, a joint axial movement of the sheath and holding cup relative to the jacket between a storage position and a partly extended position. The sheath and the jacket further have grooves that engage with a guide means on the holding cup to bring about, when the outer sleeve is rotated, an axial movement of said cup relative to the sheath and to the jacket between the partly extended position and a use position of the product. The jacket has a flexible tongue supporting the guide means.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The present invention will be understood more clearly on reading the detailed description of an embodiment taken by way of example, without implying any limitation, and illustrated in the appended drawings, in which.

DETAILED DESCRIPTION OF THE PREFERRED EMBODIMENTS

Figure 3:
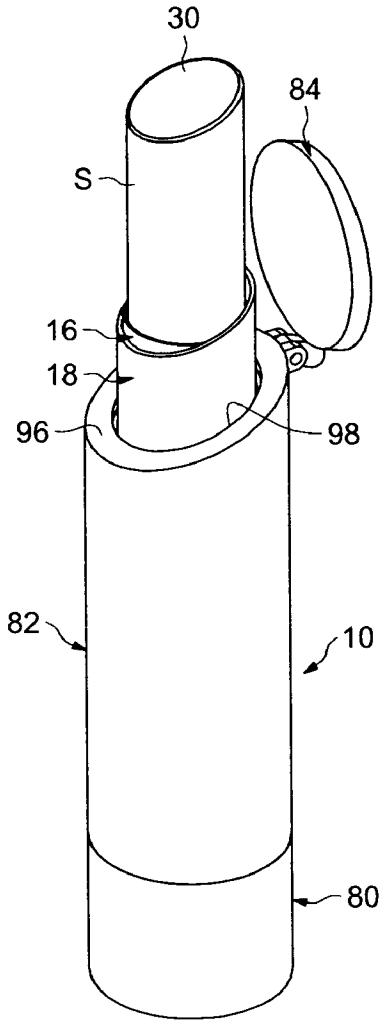
FIGS. 1 to 3 are external perspective views of a product packaging and dispensing device in storage, partly extended and use positions, respectively, of said product.

FIGS. 1 to 10 show a device, denoted by the general reference number 10, designed to be used for packaging and dispensing a stick S of product, particularly a cosmetic product.

The stick S may for example be a lipstick or a lip care product. However, it will be obvious that the device 10 can also be applied to the packaging and dispensing of other kinds of products, such as a foundation, an eye shadow, a face powder, a concealer, a medicated, cleansing or moisturizing composition, a deodorant, or a hair care product. The device 10 is shown in the figures in a position assumed to be vertical.

The device 10 comprises a stick S dispensing assembly 12 and a protective case 14 in which said dispensing assembly is housed. The protective case 14 is particularly suitable for enhancing the visual appeal of the device 10 and enabling it to be held in the hand so that the stick S can be dispensed. The cross section of the protective case 14 may be defined in accordance with that of the dispensing assembly 12. For example, it may be circular, elliptical, polygonal such as square, rectangular, hexagonal, octagonal, etc.

The dispensing assembly 12 chiefly comprises a stick holding cup 16, a sheath 18 in which said cup is mounted, and a jacket 20 around the sheath and comprising, at an upper end, a head 24 defining an outlet orifice 26 for the stick S. The assembly also comprises an outer sleeve 22 around the jacket 20, with respect to which it is rotatable to enable the stick S to be dispensed through the outlet orifice 26.

The holding cup 16, the sheath 18, the jacket 20 and the outer sleeve 22 extend along a vertical axis X-X'. The axis X-X' in this case cuts the outlet orifice 26, and more specifically is orthogonal to the latter. In this embodiment, the axis X-X' forms the longitudinal axis of the dispensing assembly 12, and more generally of the device 10. The holding cup 16, the sheath 18, the jacket 20 and the outer sleeve 22 can each advantageously be made as a single moulding in a thermoplastic, such as methylene acetate (POM) or polyamide (PA). The sheath 18 can also be made of a metallic material, such as aluminium, to give enhanced rigidity but relatively small thickness.

The generally tubular sheath 18 has an upper edge 28 which is bevelled, its inclination corresponding approximately to that of an upper bevelled surface 30 of the stick S. The upper edge 28 defines a dispensing orifice 32 for said stick. As will be described in more detail below, to enable in particular an axial displacement of the holding cup 16 relative to the sheath 18, through-grooves 34, 36 are formed all the way through the thickness of said sheath. The groove 34 comprises a longitudinal portion 34*a* extending from approximately halfway down the height of the sheath 18, axially downwards, and is extended at a lower end by a circumferential extension 34*b* situated axially towards the lower edge of the sheath 18. The groove 34 is generally L-shaped. The groove 36 comprises a longitudinal portion 36*a* extending axially downwards and extended, at a lower end, by an oblique downward extension 36*b*. The upper end of the longitudinal portion 36*a* is at a different axial height than the upper end of the longitudinal portion 34*a*. The axial dimension of the longitudinal portion 36*a* is in this case less than that of the longitudinal portion 34*a*. The grooves 34, 36 are arranged relative to each other in the circumferential direction in such a way that the extension 34*b* is diametrically opposite the longitudinal portion 36*a*.

The holding cup 16 comprises a radial transverse wall 38 which is extended axially from a large-diameter edge by an annular portion 40 which extends axially upwards. The annular portion 40 is continued on the other side of the transverse wall 38 and forms a skirt 42 which extends axially downward. The skirt 42 and the annular portion 40 are radially in contact with the bore of the sheath 18. When the stick S is in the storage position shown in FIGS. 1, 5 and 6, said stick and the holding cup 16 are housed completely inside the sheath 18. The bevelled surface 30 of the stick is approximately flush with the upper edge 28 of the sheath 18.

The stick S sits partly inside the annular portion 40 on the transverse wall 38. The cup forms a seat for the stick S. To hold the stick S more securely in the annular portion 40, it is possible to provide ribs directed radially inwards from its bore. The radial dimension of the ribs may increase progressively towards the transverse wall 38 so that the stick S is wedged in place.

Beginning at the lower end of the skirt 42 and extending axially upwards are two axial slots 44 which define on the holding cup 16 a tongue 46, which is flexible in the radial direction. A stud 48 is provided on the outer face of the tongue 46 and extends radially outwards. The stud 48 passes radially through the groove 34 in the sheath 18 to give axial guidance to the holding cup 16 relative to said sheath. The tongue 46 carrying the stud 48 facilitates the sliding assembly of the holding cup 16 into the sheath 18 because, during this operation, the tongue 46 allows the stud 48 to be displaced radially inwards until it snaps into the groove 34. The stud 48 in this case is of generally cylindrical shape. Clearly, it is also conceivable to have a stud whose general shape is rather different, for example its cross section being for example a symmetrical, especially polygonal, body of revolution.

The generally tubular jacket 20 comprises an annular portion 50 which extends axially downwards from a lower end of the head 24. The radial dimension of the annular portion 50 is less than that of the head 24 in order to create an annular radial shoulder 52 forming a stop for the assembly of the outer sleeve 22. A longitudinal groove 54 runs axially from the lower end of the annular portion 50 of the jacket 20 all the way to the radial shoulder 52. When the stick S is in the storage position, the groove 54 is lined up in the circumferential direction with the extension 34*b* of the groove 34 of the sheath 18. The groove 54 is a through-groove so that the stud 48 on the holding cup 16 can project through it.

The annular portion 50 of the jacket 20 also comprises, at its lower end, a radial bead 56. This extends outwards and is designed to be able to interfere diametrically with the outer sleeve 22 so as to retain it on the annular portion 50. The bead 56 forms a means for the axial retention of the outer sleeve 22 on the jacket 20. In other words, the bead 56 forms a means for snap-fastening the outer sleeve 22 onto the jacket 20.

The annular portion 50 of the jacket 20 further comprises, axially towards the shoulder 52, a notch 58 in the general shape of a C pointing axially downwards and defining an axial tongue 60 which is flexible in the radial direction. The tongue 60 comprises on its inner surface a radial stud 62 projecting inwards, its size being such that it can fit into the groove 36 in the sheath 18 without interfering diametrically with the outer surface of the holding cup 16. The stud 62 is diametrically opposite the groove 54.

As will be described in more detail later, the stud 62 engages with the groove 36 to allow in particular joint guidance or movement of the sheath 18 and holding cup 16 relative to said jacket. In the present case the stud 62 is generally cylindrical in shape. Of course, it is also conceivable to have a stud whose general shape is rather different, its cross section being for example a body of revolution that is symmetrical, especially polygonal.

The tongue 60 carrying the stud 62 facilitates assembling the subassembly formed by the holding cup 16 and the sheath 18 when this subassembly is slid into the jacket 20 because during this operation the tongue 60 allows the stud 62 to be displaced radially outwards until it snaps into the groove 36.

The axial dimension of the jacket 20 is slightly greater than that of the guide sheath 18 so that the upper edge 28 of said sheath is axially slightly below an upper surface 64 of the head 24 of the jacket 20 when the stick S is in the storage position shown in FIGS. 1, 5 and 6. In this position the sheath 18 is completely inside the jacket 20. The sheath 18 is radially in contact with the bore of the jacket 20 defined by the head 24 and the annular portion 50. The upper surface 64 of the jacket 20 is bevelled at the same inclination as the surface 30 of the stick S.

The sleeve 22, which is generally tubular in shape, comprises an annular body 67 whose axis is X-X'. Said body comprises a groove 68 formed in its bore so that a rotation of the sleeve about the axis X-X' can be accompanied by a joint axial movement upwards of the sheath 18 and the holding cup 16 relative to the jacket 20, followed by an axial movement upwards of said cup relative to the sheath and to the jacket. For this purpose the stud 48 on the holding cup 16 is large enough in the radial direction to pass into the groove 68, after having passed through the grooves 34 and 54 in the sheath 18 and in the jacket 20.

The body 67 of the sleeve 22 is closed at a lower axial end by a radial transverse wall 70. In the immediate vicinity of said transverse wall is an annular notch 72 formed in the thickness of the sleeve 22 without passing all the way through it in such a way as to define a radial bearing surface 74 designed to engage with the bead 56 on the jacket 20 in such a way as to make it possible to snap-fasten the sleeve 22 onto said jacket. The sleeve 22 is radially in contact with the annular portion 50 of the jacket 20 and is retained axially between the radial shoulder 52 and the bead 56. The sleeve 22 can rotate on the jacket about the axis X-X'.

The groove 68 comprises a circumferential portion 68*a* which extends axially upwards from the upper edge of the notch 72 and extends in the circumferential direction through a limited angular range which in this case is less than 180°. The groove 68 also comprises a helical portion 68*b* which continues from one circumferential end of the portion 68*a* and extends upwards until it runs out at a radially upper surface 76 of the sleeve 22 which bears against the shoulder 52 of the jacket 20.

The protective case 14 comprises a control member or actuating member 80 configured to enable the sleeve 22 to be rotated, a cap 82 which fits around the sleeve 22 and the jacket 20, and a lid 84 mounted on said cap so as to close a chamber in which the dispensing assembly 12 is completely housed. The actuating member 80 is mounted on the lower end of the cap and the lid 84 is mounted on the upper end.

The actuating member 80, whose centre is on the X-X' axis, comprises an annular body 86 that is closed at a lower axial end by a radial transverse wall 88. The control member 80 forms a base in which the sleeve 22, the jacket 20 and the sheath 18 are partly fitted. In other words, the control member fits radially around a lower part of the sleeve 22. The actuating member 80 can be retained axially on the sleeve 22 by any appropriate means, such as snap fastening by providing one or more radial hooks on the bore of the body 86 to engage with a groove in the outer surface of the sleeve 22, or vice versa.

In order to cause the sleeve 22 to be driven when the control member 80 is twisted about the axis X-X', teeth 90 are provided on the upper surface of the transverse wall 88 and meet the body 86. The teeth 90 engage by complementarity of shape with corresponding housings 92 formed in the lower surface of the transverse wall 70 of the sleeve 22. In the present case there are eight of these teeth 90 and they are distributed at regular intervals around the circumference of the transverse wall 88. The teeth 90 in this case are generally parallelepiped in shape. Clearly, it is also conceivable for both the number and distribution of the teeth on the transverse wall 88 to be different. It is also possible to have studs of a different shape for engaging by mating of shapes with the corresponding housings in the sleeve 22. In a variant, it could also be possible to have a rotationally pivoted transverse wall 88 to allow the dispensing assembly 12 to be inserted into the chamber defined by the actuating member 80 and the cap 82.

The cap 82 comprises a tubular body 94, whose axis is X-X', in axial contact with the upper edge of the actuating member 80 and which is continued, at an upper axial end, radially inwards by a bevelled annular upper wall 96 whose shape matches the upper surface 64 of the jacket 20. The upper surface 64 bears on the lower surface of the wall 96. Said wall defines an outlet orifice 98 for the stick S. The body 94 radially encloses the part of the sleeve 22 left unenclosed by the actuating member 80, and the head 24 of the jacket 20. When the stick S is in the storage position shown in FIGS. 1, 5 and 6, the dispensing assembly 12 is therefore housed completely inside the control member 80 and inside the cap 82. The cap 82 can be retained axially on the jacket 20 by any suitable means, such as snap fastening by providing one or more radial hooks on the bore of the body 94 to engage with a groove formed in the outer surface of the head 24, or vice versa. Another possibility is to have a cap 82 that snaps onto the control member 80 while allowing relative rotation between these two components, for example by having one or more studs engaging in a circular groove.

To hinge the lid 84 to the cap 82, the latter has two lugs 100 on the outer surface of the body 94 close to the wall 96, with a space between them for insertion of a projection 102 of said lid. The lid 84 is allowed to hinge by means of a pin (not shown) inserted through the lugs 100 and projection 102. The inserted pin extends transversely or at right angles to the axis X-X'. The lid 84 can thus be moved between a position in which it closes the outlet orifice 98, where it rests on the upper surface of the wall 96, and an open position, and back again.

In the embodiment illustrated, the lid 84 is mounted rotatably on the cap 82 by means of an inserted hinge pin. As a variant, the lid 84 and the cap 82 could be made in one piece with the hinge provided by a living hinge.

When the stick S is in the storage position shown in FIGS. 1, 5 and 6, the stick S is situated axially below the outlet orifices 26, 98 and the lid covers the wall 96 of the cap 82. The dispensing assembly 12 is therefore out of sight and inaccessible to the user.

In this position, the stud 48 on the holding cup 16 projects through the extension 34*b* of the groove 34 in the sheath 18 and through the groove 54 in the jacket 20. It also enters the groove 68 in the sleeve 22 in that part of the circumferential portion 68*a* which is immediately adjacent to the helical portion 68*b*. The stud 62 on the jacket 20, meanwhile, is situated at the upper end of the longitudinal portion 36*a* of the groove 36 in the sheath 18.

To allow the stick S to be moved from the storage position to a use position, the control member 80 must be rotated relative to the cap 82 about the axis X-X' so that the sleeve 22 rotates relative to the jacket 20.

The first result is that this rotation causes the subassembly consisting of the sheath 18 and the holding cup 16 to move along the axis X-X' relative to the jacket 20 and to the protective case 14. This joint axial movement is made possible partly by the stud 48 on the holding cup 16 sliding in the groove 54 of the jacket 20 and in the helical portion 68*b* of the groove 68 in the sleeve 22, and partly by the stud 62 sliding in the longitudinal portion 36*a* of the groove 36 in the sheath 18 until it reaches the lower end of said portion. Throughout this phase in which the holding cup 16 and the sheath 18 move upwards together, the stud 48 on said cup is housed in the extension 34*b* of the groove 34.

The axial dimension of the longitudinal portion 36*a* of the groove 36 will depend on how far axially it is wished for the subassembly consisting of the sheath 18 and holding cup 16 to move relative to the jacket 20 and to the protective case 14. In the embodiment illustrated, when the stud 62 on the jacket 20 is at the lower end of the longitudinal portion 36*a* of the groove 36, the sheath 18 and the stick S extend part of the way through the outlet orifices 26, 98, protruding axially from the wall 96 where they can be seen from outside the protective case 14. The lid 84 can be opened away from the outlet orifice 98 by the force of the sheath 18 and the stick S as they rise axially together. Alternatively the user can move the lid 84 before beginning to twist the actuating member 80.

Figure 7:
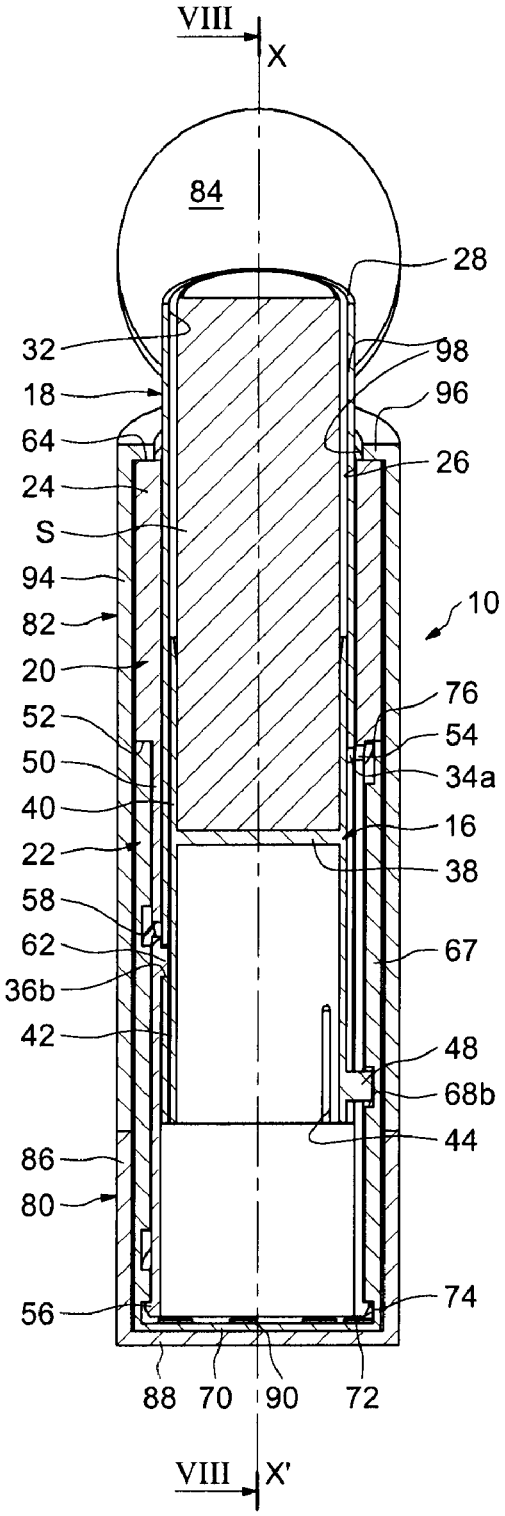
FIGS. 7 and 8 are cross sections through the device seen in the FIG. 2 position.
Figure 8:
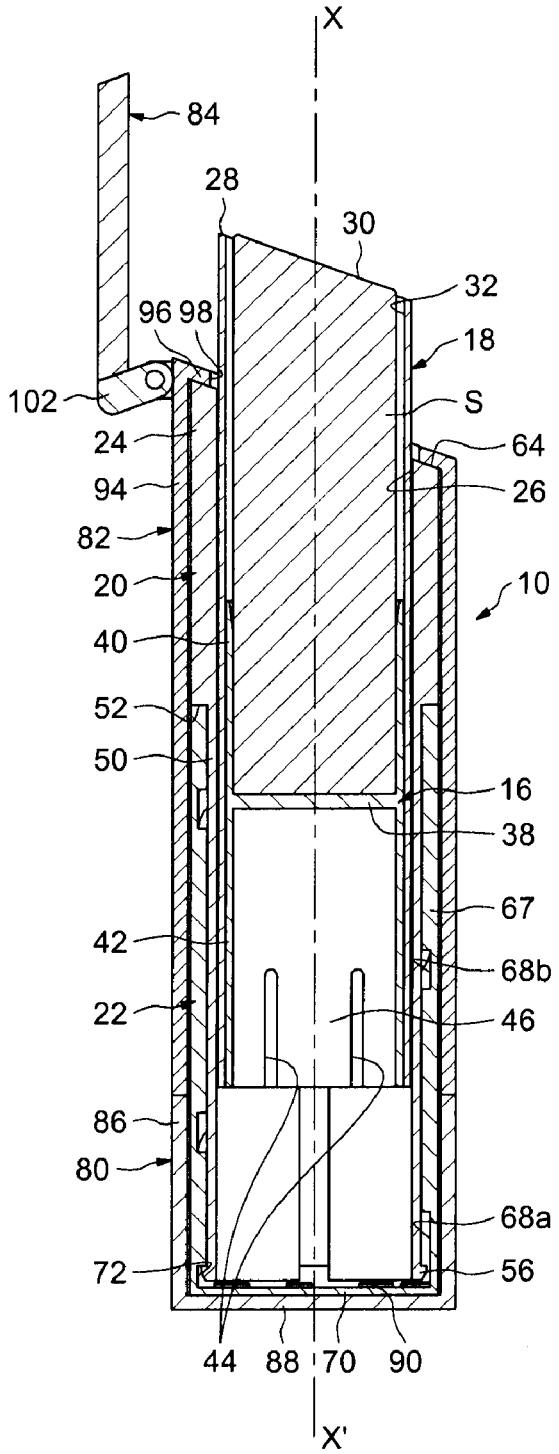

The second result is that the rotation of the sleeve 22 relative to the jacket 20, about the axis X-X', causes a short axial movement of the sheath 18 and holding cup 16 relative to the jacket 20 combined with a slight rotation of said sheath relative to the jacket and relative to the holding cup. This combined movement of translation and rotation of the sheath 18 is made possible by the fact that the stud 62 slides into the extension 36*b* of the groove 36 in the sheath 18 until it reaches the lower end of said extension. The rotation of the sheath 18 about the axis X-X' allows the stud 48 on the holding cup 16 to move from the extension 34*b* to the lower end of the longitudinal portion 34*a* of the groove 34 as illustrated in FIGS. 7 and 8 which show the stick S of product in a partly extended position. The length of the extension 36*b* of the groove 36 will depend on how far the sheath 18 is to rotate relative to the jacket 20, so that the longitudinal portion 34*a* of the groove 34 is lined up circumferentially with the groove 54 in this partly extended position. This rotation of the sheath 18 about the axis X-X' may be around about 15°.

Figure 9:
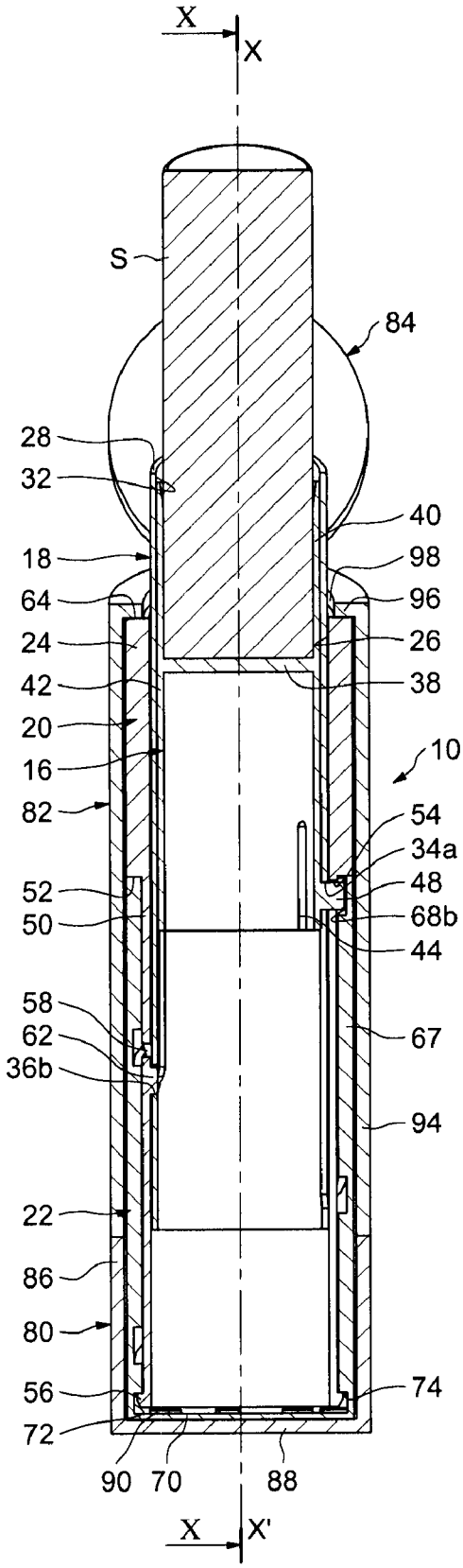
FIGS. 9 and 10 are cross sections through the device seen in the FIG. 3 position.
Figure 10:
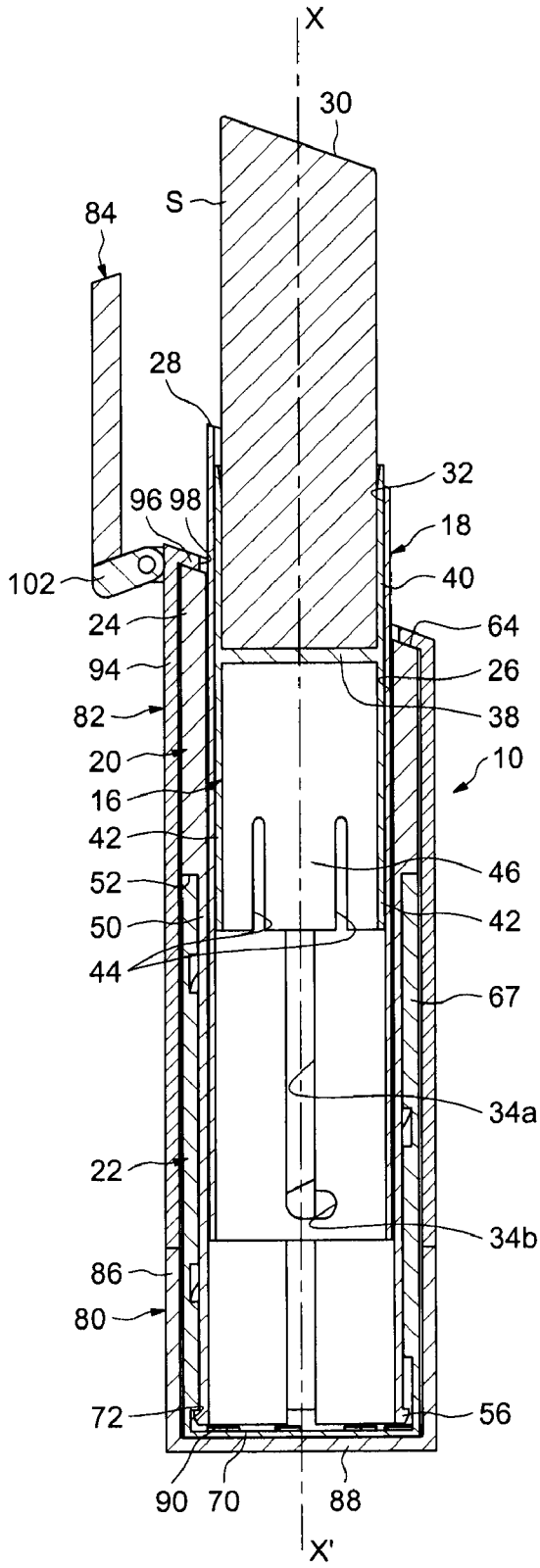

The third result is that the rotation of the sleeve 22 relative to the jacket 20, about the axis X-X', causes the stud 48 to slide along the longitudinal portion 34*a* of the groove 34 and of the grove 54 until said stud reaches the upper end of the longitudinal portion 34*a* as illustrated in FIGS. 9 and 10.

From the partly extended position of the stick S, this results in an axial sliding of the holding cup 16 relative to the sheath 18, relative to the jacket 20 and relative to the protective case 14 until the stick reaches the final extended position or use position. The axial dimension of the longitudinal portion 34*a* of the groove 34 will depend on the desired axial distance between the bevelled upper surface 30 of the stick S and the upper edge 28 of the sheath 18 when the stick is in the use position.

Figure 2:
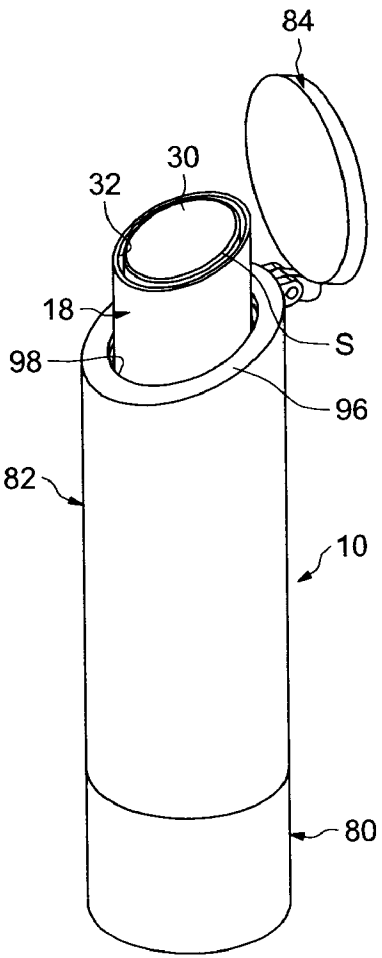
Figure 1:
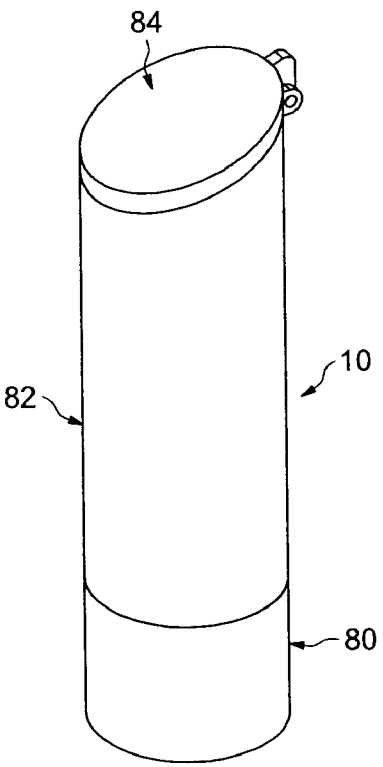
Figure 4:
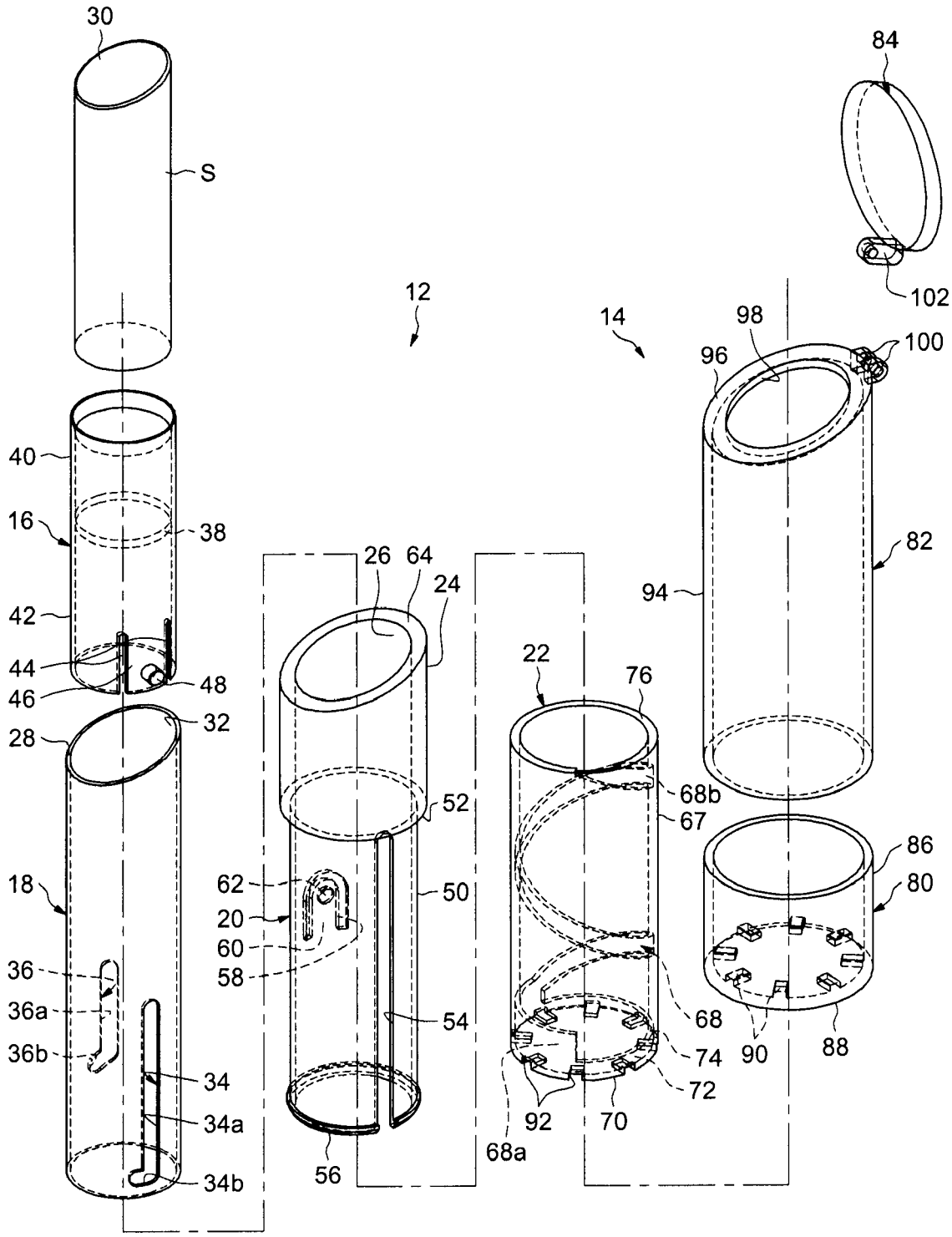
FIG. 4 is an exploded perspective view of the device seen in FIG. 1.
Figure 5:
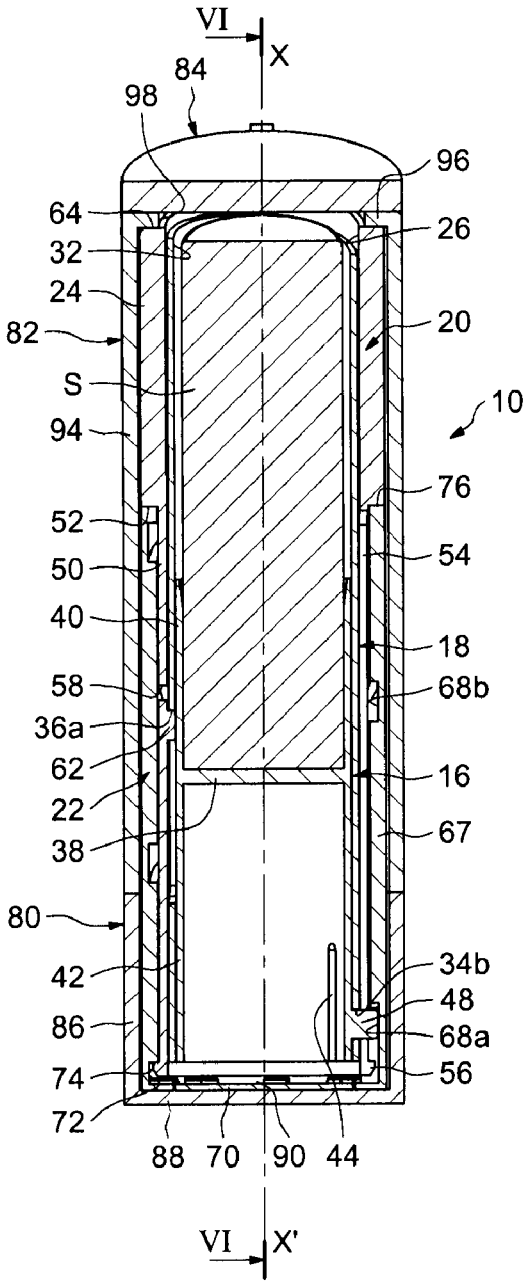
FIGS. 5 and 6 are cross sections through the device seen in the FIG. 1 position.
Figure 6:
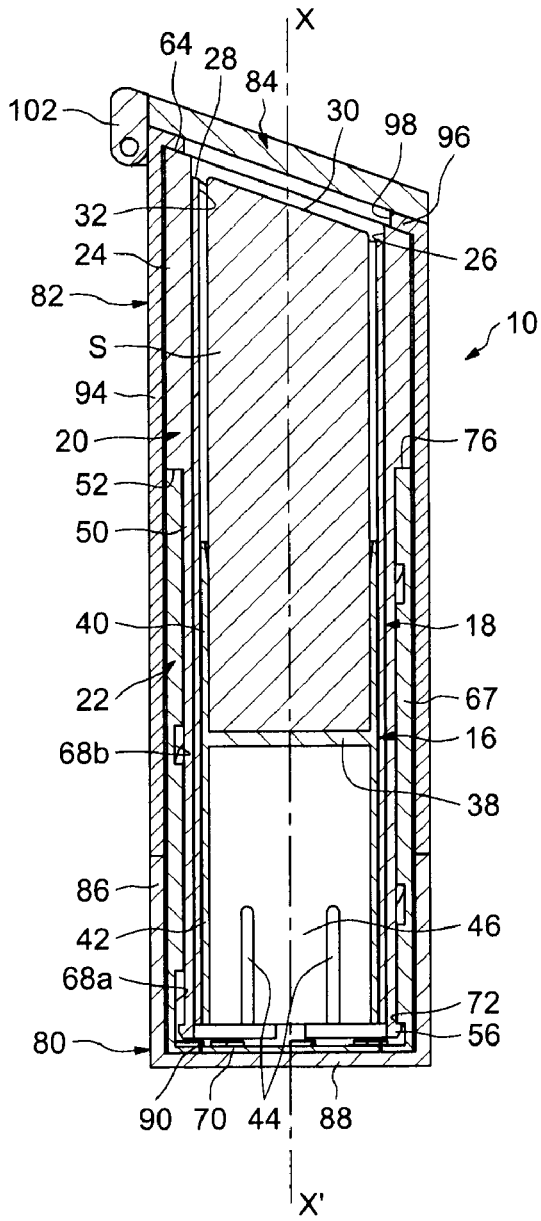

When the control member 80 is being rotated about the axis X-X', it therefore produces a sequenced movement comprising a first stage during which the sheath 18 and the holding cup 16 slide together along the axis X-X' relative to the jacket 20 and to the protective case 14, from the storage position of the stick S shown in FIGS. 1, 5 and 6 to the partly extended position shown in FIGS. 2, 7 and 8. This simultaneous axial movement is then followed by a second stage during which the only movement is the axial movement of the holding cup 16 relative to the sheath 18, to the jacket 20 and to the protective case 14, until the stick S is in the use position shown in FIGS. 3, 9 and 10. The movement from this use position to the storage position also of course occurs in a sequenced manner as the control member 80 is rotated about the axis X-X' in the opposite direction to that which enabled said stick to be dispensed.

Advantageously, at the upper end of the edges of the longitudinal portion 34*a* of the groove 34 in the sheath 18 and/or of the groove 54 in the jacket 20, an indentation in the shape of, for example, grains of rice or bumps may be made so as to enable the holding cup 16 to be locked in the use position of the stick S so that said stick does not tend to descend during application of the product if the user releases the control member 80.

As illustrated in FIGS. 3, 9 and 10, the bevelled upper surface 30 of the stick S is advantageously parallel to the upper wall 96 of the protective case 14 in the use position. The user thus knows how to pre-position the device 10 with respect to the surface to be treated in such a way as to obtain, in the extended position of the stick, the desired orientation of the bevelled upper surface 30 with respect to said surface to be treated. The teeth 90 of the control member 80 which transmit the rotation to the sleeve 22 form in this respect means of angular indexing of the sleeve relative to the protective case 14 to ensure that the bevelled upper surface 30 of the stick S is parallel to the wall 96 of the cap 82 when said stick is in the use position.

In the embodiment illustrated, the lid 84 can be opened away from the outlet orifice 98 by the fact that it is pushed by the sheath 18 and the stick S as they move axially together, or alternatively can be opened by the user before twisting the actuating member 80.

In a variant, it would also be possible to open the lid 84 when the control member 80 is being twisted to move the stick S from the storage position to the use position.

For this purpose, the circumferential portion 68*a* of the groove 68 is used to move the lid 84 from the closed position, on the outlet orifice 98, to the open position by the fact that the stud 48 on the holding cup 16 slides therein. In the course of this action, the joint axial movement of the sleeve 18 and holding cup 16 has not yet begun. With the stick S in the storage position, the stud 48 on the holding cup 16 must be in the circumferential portion 68*a* of the groove 68 at a point opposite the point immediately adjacent to the helical portion 68*b*, and the circumferential portion 68*a* must extend circumferentially through a wide enough angle so that, when the control member 80 is twisted about the axis X-X', the lid 84 is completely out of the way of the outlet orifice 98 before the stud 48 reaches the point on the circumferential portion 68*a* immediately adjacent to the helical portion 68*b* that will cause the sheath 18 and the holding cup 16 to rise. By way of indication, the circumferential portion 68*a* of the groove 68 may occupy an angle of from 5° to 355°, and especially from 100 to 200°, and preferably about 162°.

Throughout this patent application, "comprise" or "have" should be understood as meaning "comprise at least" or "have at least".

Obviously, numerous modifications and variations of the present invention are possible in light of the above teachings. It is therefore to be understood that within the scope of the appended claims, the invention my be practiced otherwise than as specifically described therein.

What is claimed is:

1. A device for packaging and dispensing a product stick, particularly a cosmetic product, comprising:

a dispensing assembly having a holding cup that forms a seat for the product stick having a beveled upper surface;

a sheath in which the holding cup is mounted, the sheath including a groove;

a jacket provided around the sheath and including a product stick outlet orifice;

an outer sleeve provided around the jacket configured to be rotated relative to said jacket, the jacket including a guide means that engages with the groove in the sheath to bring about, when the outer sleeve is rotated about an axis that cuts the outlet orifice, a joint axial movement of said sheath and holding cup relative to the jacket between a storage position and a partly extended position; and a protective case provided with a cap in which the dispensing assembly is mounted and which forms the outer cover of said assembly, and with actuating member configured to rotate the outer sleeve, the cap having a beveled upper surface parallel to the beveled upper surface of the product stick in the partially extended position, wherein the sheath and the jacket further include grooves that are configured to engage with a guide means on the holding cup to bring about, when the outer sleeve is rotated, an axial movement of said cup relative to the sheath and to the jacket between the partly extended position and a use position of the product.

2. The device according to claim 1, wherein the dispensing assembly is removably mounted in the protective case.

3. The device according to claim 1, wherein the actuating member forms a base for mounting at least part of the outer sleeve.

4. The device according to claim 1, wherein the actuating member has rotary drive means able to engage with complimentary drive means belonging to the outer sleeve.

5. The device according to claim 4, in which the drive means of the actuating member are able to engage with the complementary drive means belonging to the outer sleeve by complementarity of shape.

6. The device according to claim 1, wherein the protective case has a lid for the outlet orifice of the jacket that is movable between an orifice-closed position and an open position.

7. The device according to claim 6, wherein the lid, the actuating member, and the cap define a closed chamber in which the dispensing assembly is completely housed.

8. The device according to claim 1, wherein the cap has a bevelled upper surface defining on the protective case an outlet orifice for the product.

9. The device according to claim 1, wherein the product stick and the cap are unable to rotate relative to each other.

10. The device according to claim 1, wherein the jacket has a flexible tongue supporting the guide means.

11. The device according to claim 1, wherein the jacket has a snap-fastening means to retain the outer sleeve axially on the sheath.

12. The device according to claim 1, wherein the holding cup has a flexible tongue supporting the guide means.

13. The device according to claim 10, wherein the guide means has a stud.

* * * * *